US009273519B2

(12) United States Patent
Smith

(10) Patent No.: US 9,273,519 B2
(45) Date of Patent: Mar. 1, 2016

(54) DOWNHOLE DUAL CUTTING REAMER

(71) Applicant: TERCEL IP LIMITED, Tortola (VG)

(72) Inventor: Lee Morgan Smith, Anchorage, AK (US)

(73) Assignee: Tercel IP Ltd., Road Town, Tortola (VG)

( * ) Notice: Subject to any disclaimer, the term of this patent is extended or adjusted under 35 U.S.C. 154(b) by 318 days.

(21) Appl. No.: 14/061,684

(22) Filed: Oct. 23, 2013

(65) Prior Publication Data

US 2014/0246247 A1 Sep. 4, 2014

Related U.S. Application Data

(63) Continuation-in-part of application No. 13/889,969, filed on May 8, 2013, now Pat. No. 8,607,900.

(60) Provisional application No. 61/693,459, filed on Aug. 27, 2012.

(51) Int. Cl.

| | |
|---|---|
| ***E21B 10/44*** | (2006.01) |
| ***E21B 17/22*** | (2006.01) |
| ***E21B 10/26*** | (2006.01) |

(52) U.S. Cl.

CPC ..... *E21B 10/26* (2013.01)

(58) Field of Classification Search

CPC ..... E21B 10/26; E21B 10/44; E21B 17/22
USPC ..... 175/394, 401, 323, 406, 434, 325
See application file for complete search history.

(56) References Cited

U.S. PATENT DOCUMENTS

| | | | | |
|---|---|---|---|---|
| 3,285,678 | A | 11/1966 | Garrett et al. | |
| 3,420,323 | A | 1/1969 | Owens | |
| 4,231,437 | A | 11/1980 | Swersky et al. | |
| 4,385,669 | A | 5/1983 | Knutsen | |
| 4,610,316 | A * | 9/1986 | Boaz | E21B 17/22 175/323 |
| 5,657,820 | A * | 8/1997 | Bailey | E21B 29/06 166/117.6 |
| 7,650,952 | B2 | 1/2010 | Evans et al. | |
| 8,162,081 | B2 | 4/2012 | Ballard et al. | |
| 8,336,645 | B2 * | 12/2012 | Robson | E21B 17/10 166/241.6 |

(Continued)

FOREIGN PATENT DOCUMENTS

| | | |
|---|---|---|
| EP | 1811124 A1 | 7/2007 |
| EP | 1811125 A1 | 7/2007 |

(Continued)

OTHER PUBLICATIONS

Extended European Search Report (EP Appl. No. 14275112.2), dated Oct. 7, 2014.

*Primary Examiner* — Kenneth L Thompson
(74) *Attorney, Agent, or Firm* — Lloyd L. Davis; Andrews Kurth LLP

(57) ABSTRACT

A downhole dual cutting reamer for bidirectional reaming of a wellbore with a tubular body with two cutting sections between end segments. Each cutting section has a plurality of helical blades separated by a flute, and wherein the helical blades are formed from at least two spiral angled sections connected together, with cutting components on the spiral angled sections. The cutting components can be polydiamond cutter nodes, high strength carbide cutting nodes, and tungsten carbide facing coating. The outer diameter of each cutting section is larger than the outer diameter of each of the end segments.

15 Claims, 3 Drawing Sheets

(56) References Cited

U.S. PATENT DOCUMENTS

| | | | | |
|---|---|---|---|---|
| 8,607,900 | B1 * | 12/2013 | Smith | E21B 10/26 175/323 |
| 9,145,746 | B1 * | 9/2015 | Smith | E21B 17/1078 |
| 9,151,119 | B1 * | 10/2015 | Smith | E21B 10/26 |
| 2012/0255786 | A1 | 10/2012 | Isenhour | |
| 2014/0202770 | A1 * | 7/2014 | Zaki | E21B 10/26 175/57 |

FOREIGN PATENT DOCUMENTS

| | | | | |
|---|---|---|---|---|
| WO | 2004029402 | A1 | 4/2004 | |
| WO | WO 2004029402 | A1 * | 4/2004 | E21B 10/26 |
| WO | 2013167954 | | 11/2013 | |

* cited by examiner

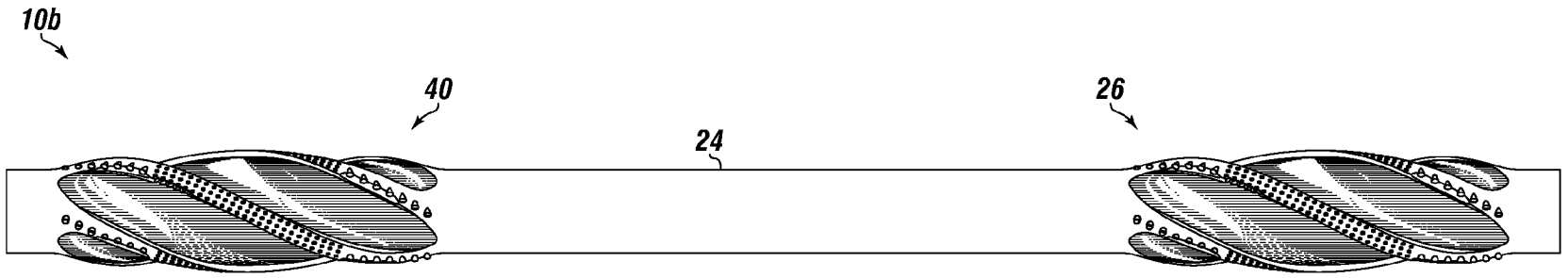
FIGURE 5
FIGURE 6
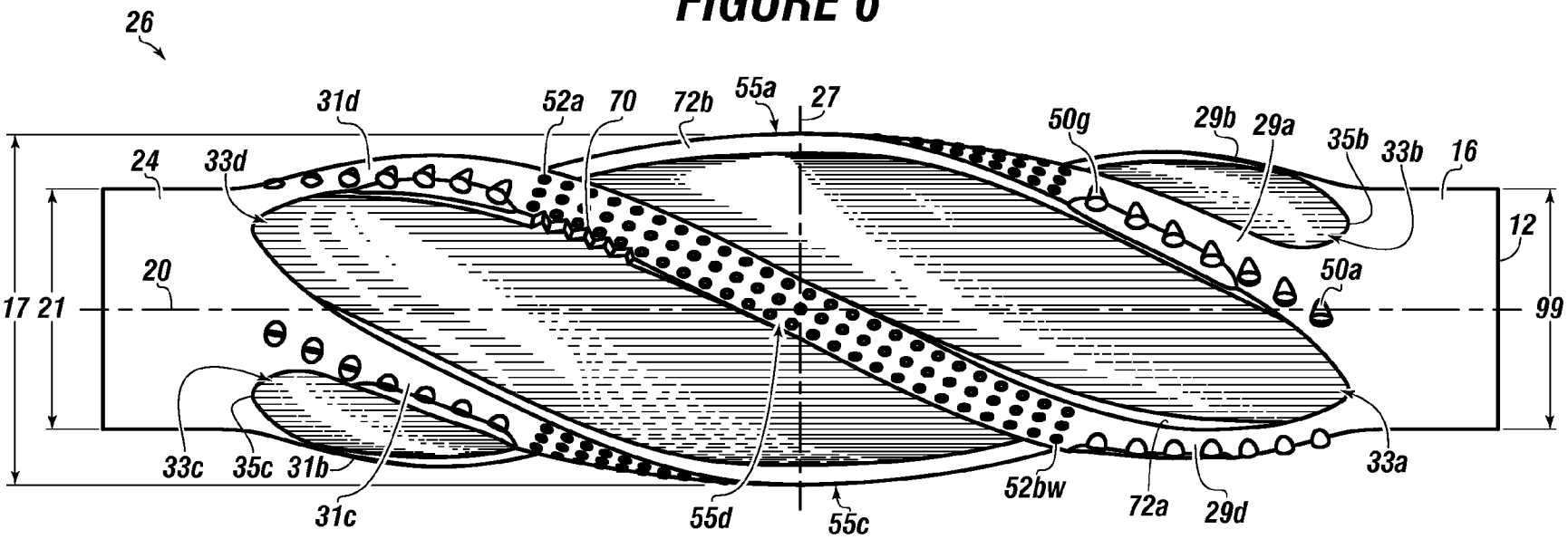

DOWNHOLE DUAL CUTTING REAMER

CROSS REFERENCE TO RELATED APPLICATION

The current application is a Continuation in Part of U.S. Utility patent application Ser. No. 13/889,969 filed on May 8, 2013, now U.S. Pat. No. 8,607,900, entitled "DOWNHOLE TOOL ENGAGING A TUBING STRING BETWEEN A DRILL BIT AND TUBULAR FOR REAMING A WELLBORE", which is a non-provisional of U.S. Provisional Patent Application Ser. No. 61/693,459 filed on Aug. 27, 2012, entitled "DOWNHOLE TOOL FOR ENGAGING A TUBING STRING BETWEEN A DRILL BIT AND TUBULAR FOR REAMING A WELLBORE." These references are incorporated herein in their entirety.

FIELD

The present embodiments generally relate to downhole drilling devices used in core drilling of wellbores.

BACKGROUND

Prior art has disclosed using polycrystalline diamond compacts in reamers, but a need exists for the ability to ream both into and out of a wellbore with tungsten carbide facings, polydiamond compacts, high density cutters, or combinations thereof, on one or both sides of reamer blades simultaneously, which is very efficient, easy to predict, and long lasting.

A need exists for a reamer with a low vibration, thereby increasing the life of measurement while drilling tools.

A need exists for a reamer that can connect to a drill string to provide increased safety for drilling personnel, by reducing the need to trip downhole equipment in and out of a wellbore.

The present embodiments relate to a dual cutting reamer which is bidirectional and can additionally be used as a drill to create a wellbore.

A need exists for a bidirectional reamer that can both widen and smooth a wellbore while being run into and out of a wellbore allowing for faster insertion and removal of bottom hole assemblies.

A need exists for a tool made of steel or a non-magnetic material that allows the tool to be used in directional drilling applications wherein a high degree of accuracy in drilling is required.

The present embodiments meet these needs.

BRIEF DESCRIPTION OF THE DRAWINGS

The detailed description will be better understood in conjunction with the accompanying drawings as follows:

FIG. 5 depicts another embodiment of the dual cutting reamer showing flute depth and a plurality of polydiamond cutting nodes with carbide cutting nodes.

FIG. 6 is a detailed view of one of the cutting members of the downhole dual cutting reamer.

Figure 1:
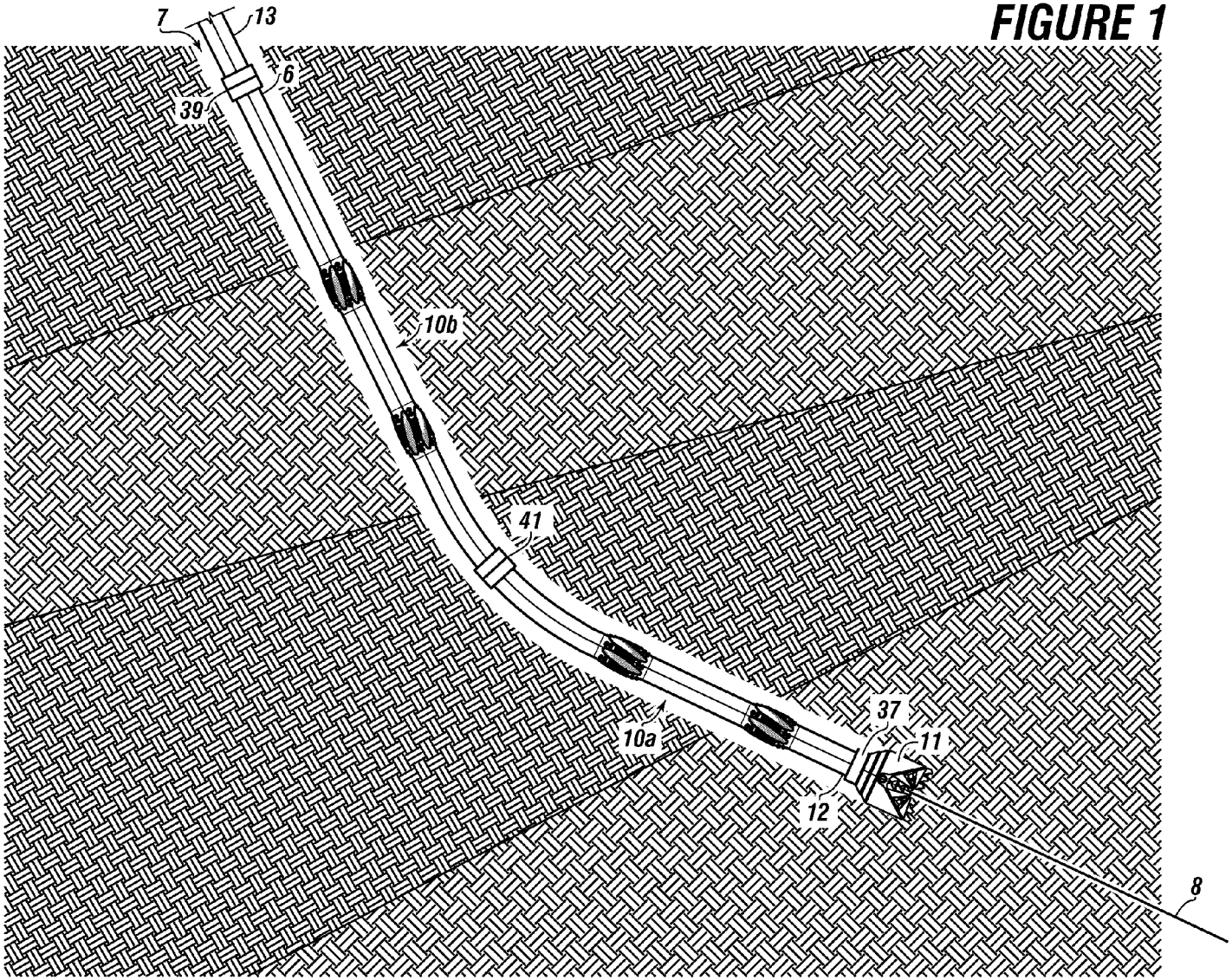
FIG. 1 is a cross sectional view of an embodiment of two connected downhole dual cutting reamers in a wellbore.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to drilling devices used in core drilling of wellbores.

The present embodiments further relate to a dual cutting reaming apparatus.

The dual cutting reaming apparatus, in an embodiment, uses tungsten carbide hard facing coating in a brick like configuration on helical blades to cut and smooth a wellbore while the dual cutting reamer is attached to a drill string and is run into and out of a wellbore.

The dual cutting reamer provides bidirectional reaming while drilling.

The downhole dual cutting reamer cuts a wellbore with a wellbore axis, in two directions while attached to a drill string. That is, the dual cutting reamer both (i) cuts while running into a wellbore and (ii) cuts while running out of a wellbore as the drill string is inserted into the wellbore and pulled out of the wellbore.

The tool, in embodiments, can be attached between the drill bit and a tubular for use in drilling an oil, gas or water well.

The downhole dual cutting reamer has a central annulus which can allow mud to be pumped through the tool and used for enhanced drilling. This central annulus can be in the center of the tubular, or positioned off center in the tubular.

An advantage of this downhole dual cutting reamer is that the downhole dual cutting reamer can be usable in 10,000 foot wells at depths including but not limited to 18,000 feet. In one or more embodiments, the downhole dual cutting reamer can be usable in wells with depths from 1,000 feet to 30,000 feet.

In one or more embodiments, the downhole dual cutting reamer can be usable with swell packers. The dual cutting reamer can be attached to a swell packer on one end as the swell packer is run into the wellbore.

Currently, operators are using from 20 to 40 plus swell packers or mechanical packers. These drilling operators need a very clean bore for accurate and precise swell packer placement.

The drilling operators can use this downhole dual cutting reamer to enable swell packers or mechanical packers to be placed at the precise position that they are needed in the wellbore. Not only does the reamer enable the swell packers to be accurately placed at the precise depth, but it also prevents the need to pull the drill string out of the hole when swell packers are not placed at the proper depth. The present apparatus allows for placement in one shot.

An advantage of the downhole dual cutting reamer is that the downhole dual cutting reamer enables the creation of a very clean, smooth wellbore, with no large pieces of rock sticking out of the wellbore that would damage or cause misplacement of the swell packer or other liner completion equipment.

Another advantage of the downhole dual cutting reamer is that the downhole dual cutting reamer is made up into the bottom hole assembly, replacing conventional stabilizers.

The downhole dual cutting reamer provides a less expensive solution to conventional stabilizers.

The downhole dual cutting reamer can perform drilling out of casing, and measurement while drilling to simplify drilling operations to a single trip instead of current technology that requires multiple trips.

Since each trip into the well can cost about $250,000 per trip, only needing one trip for reaming the wellbore can save about $250,000 per reaming job over currently available single directional reamers.

The downhole dual cutting reamer provides smooth wellbores, which allow for faster drilling and faster packer installations.

An advantage of this downhole dual cutting reamer is that larger outer diameter swell packers can be usable in drilling, which can safely support high pressure in the well and provide a better frac job on a well.

The downhole dual cutting reamer can be usable to drill out through float equipment of a well. There is no need to trip out before drilling ahead by using this reamer, this dual cutting reamer reduces drilling by at least 1 trip out of the wellbore.

The downhole dual cutting reamer can be usable to drill rock and ream the wellbore simultaneously.

The downhole dual cutting reamer can ream while operating measurement while drilling equipment also known as "MWD" equipment.

In embodiments, two dual cutting reamers can be connected together and used in tandem in the wellbore, with one end of the tandem engagement connected to a drill bit and the other end connected to a tubular.

The dual cutting reamer uses lower torque and lower maintenance cost than other reamers.

The downhole dual cutting reamer can have a central annulus allowing the flowing of drilling mud in one direction and well material in another direction.

In embodiments, the tubular body can include a non-magnetic material, such as a non-magnetic steel, known as MONEL™.

The tubular body in embodiments can have a longitudinal axis extending from one end to the other end.

The downhole dual cutting reamer can rotate about the longitudinal axis to cut the rock. The cutting sections can bulge away from the longitudinal axis between the first end segment and the second end segment.

In embodiments, the dual cutting reamer can use two 6 inch in length cutting sections or two 1.5 inches in length cutting sections.

In embodiments, the cutting sections can have identical lengths along the longitudinal axis of the tubular body.

In embodiments, the cutting sections can have different lengths and can still be usable in the invention. The cutting section lengths can be from 1.5 inches to 12 inches.

In embodiments, the dual cutting reamer can be used with geosteering tools, to ream while attached to geosteering equipment, cutting curves in the wellbore.

The downhole dual cutting reamer can have at least two helical blades per cutting section formed as part of the tubular body.

The end segments can each be 1 percent to 10 percent the overall length of the tool. The end segments can be formed extending from each end of the tool.

The middle segment can range from 1 percent to 10 percent of the overall length of the tool. The middle segment can connect directly to each cutting section of the reamer.

The middle segment has an annulus. The annulus can extend from a first end of the tubular body through the cutting sections and through the middle segment creating a flow path from one end of the tool to the other end of the tool.

In one or more embodiments, from 2 helical blades to 16 helical blades can be usable in each cutting section. Each helical blade can have a length from 1 inch to 80 inches.

In embodiments, each cutting section can have at least one helical blade.

First Cutting Section

A first cutting section can have a first spiral angled section increasing in radius from the first end segment towards a midpoint of the first cutting section of the downhole dual cutting reamer. The midpoint can intersect at a right angle with the longitudinal axis.

Each helical blade of the first spiral angled section can extend away from the first end segment at an angle from about 1 degree to about 20 degrees. In embodiments, the helical blade does not extend to the first end of the tool as weakness can occur with the helical blade extending to the end.

Each helical blade can have a second spiral angled section extending away from a middle segment at an angle from about 1 degree to about 20 degrees towards the midpoint of the first cutting section.

The second spiral angled section can increase in radius from the middle segment towards the midpoint of the downhole dual cutting reamer.

Both the first and second spiral angled sections of the first cutting segment converge on the midpoint of the first cutting segment of the downhole dual cutting reamer.

Each spiral angled section can be formed at the same angle per cutting segment, forming a smooth curve from one end of the cutting segment to the other end segment of the cutting segment.

Second Cutting Section

The second cutting section can be constructed in a manner similar to the first cutting section, although the number of helical blades can be varied. Additionally, the length of the helical blades along the longitudinal axis of the tool in the second cutting section can differ from the first cutting section.

The second cutting section can have a second cutting section with a first spiral angled section increasing in radius from the second end segment towards a midpoint of the second cutting section of the downhole dual cutting reamer. The midpoint can intersect at a right angle with the longitudinal axis.

Each helical blade of the second spiral angled section can extend away from the second end segment at an angle from about 1 degree to about 20 degrees. In embodiments, the helical blade of the second cutting section does not extend to the second end of the tool as weakness can occur with the helical blade extending to the end.

Each helical blade of the second cutting section can have a second spiral angled section extending away from a middle segment at an angle from about 1 degree to about 20 degrees towards the midpoint of the second cutting section.

The second spiral angled section of the second cutting segment can increase in radius from the middle segment towards the midpoint of the downhole dual cutting reamer.

Both the first and second spiral angled sections of the second cutting segment converge on the midpoint of the second cutting segment of the downhole dual cutting reamer.

In embodiments, spiral angled sections can extend away from the end segments at an angle ranging from about 10 degrees to about 30 degrees from a plane of the first and second end segments.

In one or more embodiments, the helical blades can have more than two spiral angled sections per blade.

The spiral angled sections can be integrally connected to each other forming a smooth continuous helical blade with great strength, easily twice the strength of other types of reamers without deforming.

Mini-Reamer

In embodiments, the downhole dual cutting reamer can use helical blades in each of the two cutting sections that range in width from about 1.5 inches to about 6 inches, and can be used for mini-reaming.

One Piece or Modular

In one or more embodiments, the tubular body can be a one piece integral steel component, formed from a single piece of cut steel.

In another embodiment, the helical blades can be welded or threaded to the tubular body forming each cutting section.

Cutting Components

Tungsten Carbide "Brick Like" Cutting Component

In embodiments, tungsten carbide coating can be applied as a facing on the helical blades. These facings can be rectangular "brick like" in configuration and be applied in a pattern that resembles brick work. In embodiments, the rectangles are not aligned evenly with each other, that is one brick facing is applied ½ the length of the brick facing that is one line above it, so that the pattern looks like bricks of a house or a brick wall, which provides great strength to the facing and in itself makes the tool tougher and longer lasting.

These tungsten carbide facings are thermally stable.

In embodiments, the tungsten carbide facing coatings can be flush mounted rectangular brick shapes.

The height of each brick as measured from the surface of one of the spiraled angled sections can range from flush flat to about ¼ of an inch.

Polydiamond Cutting Nodes

Pluralities of polydiamond cutting nodes can be disposed on each spiral angled section. The polydiamond cutting nodes can be grouped in circles, organized in swirl patterns, or in another pattern.

The density of the polydiamond cutting nodes in embodiments can range from about 1 per inch to about 6 per inch. In an embodiment the polydiamond cutting nodes can be aligned in rows of 2 polydiamond cutting nodes to 16 polydiamond cutting nodes. In another embodiment, the polydiamond cutting nodes can be aligned in two rows per spiral angled section.

In an embodiment, the polydiamond cutting nodes can be made from synthetic diamond material made by US Synthetic located in Orem, Utah.

The polydiamond cutting nodes, in embodiments, can be flat faced, dome shaped, or combinations of these configurations.

The polydiamond cutting nodes can have a shape that is elliptical, circular, angular, or combinations of these configurations.

The height of each polydiamond cutting node as measured from the surface of one of the spiraled angled sections can range from flush flat to about ¾ of an inch.

Carbide Cutting Nodes

In an embodiment, each spiral angled section can have high strength carbide cutting nodes formed thereon.

The high strength carbide cutting nodes can be formed on the spiral angled section in a single row, double rows, triple rows, multiple rows, or in patches. The high strength carbide cutting nodes are known as "carbide inserts" in the industry.

Usable high strength carbide cutting nodes can be round, elliptical, or angular. Usable high strength carbide cutting nodes can be flat faced or round faced.

In embodiments, teeth can be created on one or both edges of one or more of the spiral angled sections to enhance cutting by at least one of the helical blades.

Flutes

In one or more embodiments, flutes can be located between the helical blades. Each of the flutes can provide a "junk slot volume" providing an optimum drilling mud flow path and cuttings removal channel allowing "junk" from the wellbore to freely flow past the downhole dual cutting reamer without impeding operation. The flutes are critical for the tool to continuously operate bidirectionally. In embodiments, the flutes can be tapered on both ends.

The helical spiral shape of the blades on the downhole dual cutting reamer can enable the downhole dual cutting reamer to slide easily in the wellbore.

In embodiments, a first connector can couple to the first end of the downhole dual cutting reamer to engage a bottom hole assembly component, such as a drill bit.

In embodiments, a second connector can couple to the second end of the downhole dual cutting reamer to engage a bottom hole assembly component, such as a tubular.

In embodiments, a third connector can couple together two downhole dual cutting reamers to engage a first bottom hole assembly on one end of the first reamer, and a second bottom hole assembly on the other end of the second reamer.

The downhole dual cutting reamer can use a box connection for providing quick install and removal of the tool from the drill string as the first connector, second connector, third connector, or combinations thereof.

The quick install and removal connection can engage a float assembly, or a measurement while drilling component (MWD) component.

In one or more embodiments, each cutting section of the downhole dual cutting reamer can be made from a cutting material with more flexibility than the base tubular, thereby enabling the downhole dual cutting reamer to continue in the presence of stiff rock without breaking. The downhole dual cutting reamer can be constructed from two different materials, each having different physical properties. For example, each cutting section can be a softer material than the tubular surrounding the annulus.

If two different reamers are used and connected together, in embodiments, the first dual cutting reamer can be made from a first hard steel and the second dual cutting reamer can be made from a cheaper, less expensive material, that is lighter and easier to pull when the drill string is pulled from the hole.

In embodiments, the downhole dual cutting reamer can have a downhole dual cutting reamer outer diameter calculated from an outermost surface of the spiral angled section.

In one or more embodiments, the downhole dual cutting reamer outer diameter can range from about 3 inches to about 36 inches and can have specific outer diameters of 5 and ¾ inches, 5 and ⅞ inches, 6 inches, 6 and ¾ inches, 8 and ¾ inches, 8 and ⅝ inches, 9 and ¾ inches, 9 and ⅞ inches, 10 and ⅝ inches, 12 inches, 13 and ½ inches, 16 inches, and 17 and ½ inches.

In embodiments, the downhole dual cutting reamer can have high strength carbide cutting nodes that are made from a tungsten carbide material, such as Casmet Supply Ltd of Penticton, British Columbia products identified as "tungsten carbide inserts." The synthetic diamond cutting material can be one such as those made by US Synthetic and referred to as "stud cutter 2184" a diamond enhanced cutting material. Casmet Supply Ltd also provides a tungsten carbide insert with diamond particles positioned on it, or a diamond impregnated metal matrix, such as US Synthetic product termed "stud cutter" with a mix of natural diamond and synthetic diamonds, or combinations of these materials.

In one or more embodiments, the helical blades can be up to 22 inches in length for a 5 and ⅞ inch diameter downhole dual cutting reamer. The helical blades can be longer, up to 48 inches.

The downhole dual cutting reamer can be installable anywhere in the bottom hole assembly or adjacent a drilling component including the drill bit.

Turning now to the Figures, FIG. 1 shows a wellbore 7 with a wellbore axis 8. A first bottom hole assembly component 11 is shown in the wellbore 7.

In this embodiment, two downhole dual cutting reamers 10*a* and 10*b* are depicted connected together.

The first bottom hole assembly component 11 is depicted as a drill bit.

A first connector 37 can connect the first bottom hole assembly component 11 to a first end 12 of a first downhole dual cutting reamer 10*a*.

A second connector 39 connects a second bottom hole assembly component 13 to a second end 6 of the second downhole dual cutting reamer 10*b*.

In embodiments the first and second ends of the downhole dual cutting reamers can be run into the drill bit in a flush threaded connection without using a connector.

The first and second downhole dual cutting reamers 10*a* and 10*b* can be connected together with a third connector 41.

Figure 2:
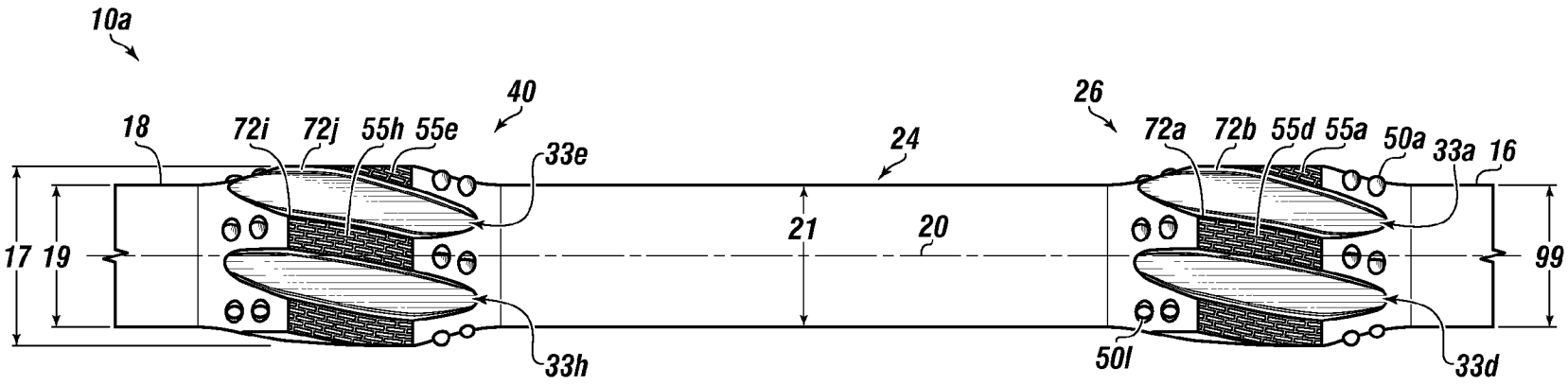
FIG. 2 is a detailed side view of an embodiment of the downhole dual cutting reamer.

FIG. 2 shows a detailed side view of an embodiment of the downhole dual cutting reamer 10*a* with a first end segment 16 and a first end segment outer diameter 99.

The downhole dual cutting reamer 10*a* is shown with a second end segment 18 with a second end segment outer diameter 19. In embodiments the outer diameters of the end segments can be identical.

The downhole dual cutting reamer shown in this Figure can have a generally cylindrical body with a longitudinal axis 20.

A first cutting section 26 is depicted with a plurality of helical blades 55*a*-55*d*.

Each helical blade of the first cutting section extends between the first end segment 16 and a middle segment 24. Four helical blades can be used in the first cutting section.

A flute can be disposed between pairs of helical blades. This embodiment shows the flutes 33*a* and 33*d*.

Each flute has sides sloping away from the helical blades towards a center point of the flute. The depth of each flute causes the flute to form a trough that is equivalent in depth to the first end segment outer diameter or the middle segment outer diameter 21.

Flutes, in embodiments, can have a flute depth that ranges from 0 percent to 15 percent less than at least one of: (a) the first end segment outer diameter, (b) the second end segment outer diameter, and (c) the middle segment outer diameter.

In an embodiment, a row of polydiamond cutting nodes 50*a*-50*l* can be installed on the helical blades of the first cutting section.

Each helical blade can be made from a first spiral angled section that increases in radius from the first end segment towards a midpoint of the cutting section. Each helical blade can be made from a second spiral angled section that increases in radius from the middle segment towards a midpoint of the cutting section.

The polydiamond cutting nodes can be installed on the spiral angled sections that form the helical blades.

The midpoint of the helical blades intersects at a right angle with the longitudinal axis 20. The angle of the first spiral angle section can be 7.7 degrees+/−0.5 degrees from the longitudinal axis.

In embodiments, each spiral angled section can have from 3 polydiamond cutting nodes to 10 polydiamond cutting nodes. The polydiamond cutting nodes can be positioned in a single row, in a pair of rows, or even in a circle or swirl pattern on the surface of the first spiral angled section.

In embodiments, the polydiamond cutting nodes can be disposed solely on one of the two spiral angled sections.

In embodiments, each polydiamond cutting node can have a diameter ranging from about ⅜ inch to about 1 inch.

In embodiments, each polydiamond cutting node can have a shape that is at least one of: a planar surface, a concave shape, a triangular shape, or a convex shape.

In embodiments, a polydiamond cutting node can be crested or braised onto each spiral angled section.

In embodiments, each polydiamond cutting node can be disposed on portions of each spiral angled section proximate the midpoint.

Alternatively, a plurality of high strength carbide cutting nodes can be disposed on portions of each spiral angled section proximate the midpoint.

In still another embodiment, both polydiamond cutting nodes and high strength carbide nodes can be used on portions of the spiral angled sections.

In yet other embodiments, the spiral angled sections can each have a tungsten carbide facing coating disposed thereon. The coating is "brick like" and depicted in the Figure.

Each helical blade can have blade edges, such as blade edges 72*a* and 72*b* for the first cutting section.

In embodiments, the blade edges can be smooth, have teeth, or combinations of smoothness with teeth.

In embodiments, the high strength carbide cutting nodes can be arranged in more than one row, such as pairs of rows, or multiple rows.

In an embodiment, the high strength carbide cutting nodes, the polydiamond cutting nodes, and/or the tungsten carbide facing coating can be installed on the blades in patches. For example, in an embodiment, densely clustered high strength carbide cutting nodes can be formed in each patch along a spiral angled section. The high strength carbide cutting nodes and/or the tungsten carbide facing coating can also be formed in the spiral angled section in swirl or helical patterns.

The high strength carbide cutting nodes can each have a diameter from about ⅛ inch to about ¾ inch. Each high strength carbide cutting node can be flush, creating friction. The high strength carbide cutting nodes being flush can cause the helical blades to last longer since the high strength carbide cutting nodes are harder than the steel of the helical blades.

In an embodiment, the high strength carbide cutting nodes can be positioned offset to each other, not in orderly rows.

In one or more embodiments, a higher quantity of polydiamond cutting nodes can be used on each of the first spiral angled sections. The second spiral angled section can have a lesser number of cutting nodes, depending on the particular use intended for the cutting tool.

In an embodiment, the helical blades can be 22 inches long, with high strength carbide cutting nodes, polydiamond cutting nodes and tungsten carbide facings on each helical blade.

A single helical blade can be 22 inches long, and have about 180 high strength carbide cutting nodes on the helical blade along with 100 polydiamond cutting nodes and 2 inches of tungsten carbide facing coating on each blade.

FIG. 2 also shows the second cutting section 40. The second cutting section 40 can have a cutting section outer diameter 17.

In this embodiment, the two cutting sections of the reamer have identical outer diameters.

In other embodiments, the first cutting section can have an outer diameter greater than the second cutting section.

In yet other embodiments, the second cutting section can have an outer diameter larger than the first cutting section.

In embodiments, the outer diameter of each cutting section of the tool can be as large as 36 inches.

The second cutting section can have helical blades 55*e*-55*h* with flutes 33*e*-33*h* labeled. The blade edges 72*i* and 72*j* of the helical blades are also shown. The second cutting section can be positioned as part of the tubular body between the middle section 24 and the second end segment 18.

Figure 3:
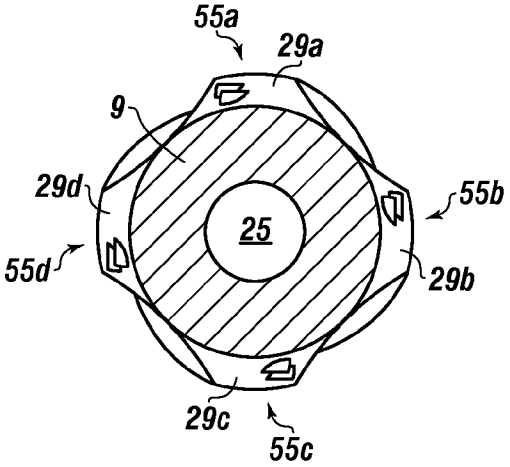
FIG. 3 is a view of an embodiment of the dual cutting reamer from a first end of the tubular body with first spiral angled sections extending away from a longitudinal axis of the dual cutting reamer.

FIG. 3 is a view from the first end of the tubular body. In this embodiment first spiral angled sections 29*a*-29*d* can extend from the tubular body.

The first spiral angled sections 29*a*-29*d* of the first cutting section are shown extending from the tubular body 9 having the central annulus 25.

The spiral angled sections connect together to form the helical blades 55*a*-55*d*.

In an embodiment, the annulus 25 can have a 2.5 inch inner diameter and the overall outer diameter of each cutting section of the tool can be 5 and ⅞ inches.

Fluid can flow through the annulus bi-directionally. The fluid can flow from the surface to the downhole assembly, the drill bit, and then up the flutes to the surface.

Figure 4:
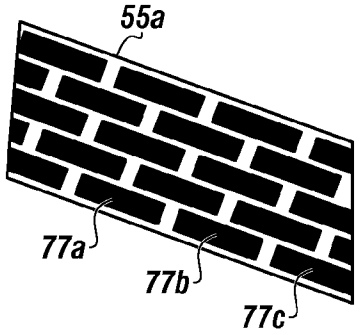
FIG. 4 is a detail of an embodiment of the tungsten carbide "brick like" facing coating as it would look if it were positioned on a helical blade.

FIG. 4 is a detail of the tungsten carbide facing coating 77*a*-77*c* applied to the helical blade 55*a*. The tungsten carbide facing coating can be installed as rectangular shaped components, like "bricks" in a brick work like manner, with each level of facings being offset with the next level of facings.

The tungsten carbide facing coating can be installed on each helical blade. Each facing surface can have a thickness of about 3 mm.

In embodiments, the tungsten carbide facing coating can be annealed on each spiral angled section.

In embodiments, the tungsten carbide facing coating can be a crushed tungsten carbide in a nickel bronze matrix.

In embodiments, the tungsten carbide facing coating can be a plurality of separated tungsten carbide cutting segments, such as 6 to 20 rectangular cutting segments, or segments formed in other shapes, such as polygonal, square, octagonal, or triangular.

FIG. 5 shows another embodiment of a downhole dual cutting reamer 10*b* with a first cutting section 26, second cutting section 40, and middle section 24 with polydiamond and carbide cutting nodes disposed thereon as another embodiment of the apparatus.

FIG. 6 depicts a detail of first cutting section 26.

A first end segment 16 can form a first end 12. The first end segment can have a first end segment outer diameter 99.

A middle segment 24 can connect to the first cutting section opposite the first end segment 16.

The middle segment can have a middle segment outer diameter 21.

The first cutting section can have a longitudinal axis 20 extending from the first end 12 through the middle segment and eventually to the second end which is not shown.

The first cutting section can include a plurality helical blades 55*a*-55*d* are shown.

Each helical blade can have blade edges 72*a* and 72*b*.

One of the blade edges can have teeth 70 formed on a portion of the helical blade.

Each helical blade can be made from a first spiral angled section 29*a*-29*d*.

The first spiral angled sections can increase in radius from the first end segment 16 to a midpoint 27 of the first cutting section. The midpoint intersects at a right angle to the longitudinal axis 20.

The helical blades can each be formed from a second spiral angled section 31*b*-31*d* are indicated. The second spiral angled sections can increase in radius from the middle segment 24 to the midpoint 27 of the first cutting section.

A plurality of first cutting section flutes 33*a*-33*d* are shown. One flute can be disposed between each pair of helical blades.

Each first cutting section flute can have a flute depth that is up to 25 percent less than at least one of: the first end segment outer diameter and the middle segment outer diameter.

The first cutting section outer diameter 17 can be greater than the first end segment outer diameter 99 and the middle segment outer diameter 21.

Disposed on at least one of the spiral angled sections, can be at least one of: a plurality of polydiamond cutting nodes 50*a*-50*g*; and a plurality of high strength carbide cutting nodes 52*a*-52*bw* with raised surfaces.

The flutes can have tapered edges 35*b* and 35*c*.

In an embodiment, each helical blade can be tempered prior to installing the polydiamond cutting nodes, high strength carbide cutting nodes, or combinations thereof. In embodiments, a surface Brinell hardness can be HB 285-341.

In one or more embodiments, each cutting section can have a cutting section outer diameter that is greater than each end segment outer diameter and a plurality of helical blades. Each helical blade can have a first spiral angled section increasing in radius from the first end segment towards a midpoint of the downhole dual cutting reamer, wherein the midpoint intersects at a right angle with the longitudinal axis. Each helical blade can have a second spiral angled section increasing in radius from the second end segment towards the midpoint of the downhole dual cutting reamer.

In embodiments either (1) a plurality of polydiamond cutting nodes can be securely attached, such as with welding, or a threaded engagement on portions of each angled section proximate the midpoint, (2) a plurality of high strength carbide cutting nodes can be disposed on each angled section away from the midpoint, or (3) combinations of both types of nodes can be used on each of the spiral angled sections of the blades.

The downhole dual cutting reamer can rotate about the longitudinal axis allowing each cutting section to ream the wellbore. Each cutting section can bidirectionally ream a wellbore while allowing drill fluid to flow down an annulus of the tubular body while simultaneously allowing wellbore particulates to flow up and across the flutes. The simultaneous action is both novel and provides improved safety in the well.

In embodiments the downhole dual cutting reamer can be used with measurement while drilling equipment.

In embodiments the downhole dual cutting reamer can be used with geosteering drilling equipment.

In embodiments, the downhole dual cutting reamer can be a mini-reamer with only 1.5 inch long cutting segments per tool, whereas standard reamers have 15 inches to 20 inches of reaming surface.

In embodiments the downhole dual cutting reamer can have cutting sections that are 6 inches in length.

The dual cutting reamer can be made from nonmagnetic material in embodiments.

The dual cutting reamer protects bottom hole assemblies from excessive wear saving tripping out of the hole which can cost $250,000 per trip and save lives by oil field workers not having to endure the danger of tripping equipment out of a wellbore. Tripping is known in the industry to be the most hazardous part of the drilling operation to workers at the site.

While these embodiments have been described with emphasis on the embodiments, it should be understood that within the scope of the appended claims, the embodiments might be practiced other than as specifically described herein.

What is claimed is:

1. A downhole dual cutting reamer for use in a wellbore with a wellbore axis configured for engaging a first bottom hole assembly on a first end and a second bottom hole assembly on a second end, wherein the downhole dual cutting reamer comprises a tubular body having an annulus, wherein the tubular body comprises:

a) a first end segment forming the first end having a first end segment outer diameter;

b) a second end segment forming the second end having a second end segment outer diameter;

c) a middle segment disposed between the first end segment and the second end segment with a middle segment outer diameter;

d) a longitudinal axis extending from the first end through the middle segment to the second end; and e) a first cutting section extending longitudinally from the first end segment to the middle segment having a first cutting section outer diameter, the first cutting section comprising:

(i) a plurality of first cutting section helical blades, each first cutting section helical blade having a blade edge, and each first cutting section helical blade comprising:

1) a plurality of first cutting section helical blades, each first cutting section helical blade having a blade edge;

2) a first spiral angled section increasing in radius from the first end segment to a midpoint of the first cutting section, wherein the midpoint intersects at a right angle to the longitudinal axis; and 3) a second spiral angled section increasing in radius from the middle segment to the midpoint of the first cutting section;

(ii) a plurality of first cutting section flutes, each flute disposed between a pair of helical blades, wherein each first cutting section flute has a flute depth greater than 0 percent and up to 25 percent less than the first end segment outer diameter and the middle segment outer diameter; and (iii) a first cutting section outer diameter greater than the end segment outer diameter and the middle segment outer diameter;

f) a second cutting section extending longitudinally from the second end segment to the middle segment having a second cutting section outer diameter, the second cutting section comprising:

(i) a plurality of second cutting section helical blades, each second cutting section helical blade having an edge, each second cutting section helical blade comprising:

1) a second cutting section first spiral angled section increasing in radius from the second end segment to a midpoint of the second cutting section, wherein the midpoint intersects at a right angle to the longitudinal axis; and 2) a second cutting section second spiral angled section increasing in radius from the middle segment to the midpoint of the second cutting section;

(ii) a plurality of second cutting section flutes, each flute disposed between a pair of helical blades, wherein each flute has a flute depth greater than 0 percent and up to 25 percent less than the second end segment outer diameter and the middle segment outer diameter;

g) at least one of: a plurality of thermally stable tungsten carbide cutting facings; a plurality of polydiamond cutting nodes; and a plurality of high strength carbide cutting nodes with raised surfaces disposed on the spiral angled sections; and h) as the downhole dual cutting reamer rotates about the longitudinal axis, each cutting member and the helical blades bidirectionally ream the wellbore while allowing drill fluid to flow down an annulus of the tubular body while simultaneously allowing wellbore particulates to flow up the wellbore and across the flutes.

2. The downhole dual cutting reamer of claim 1, wherein the downhole dual cutting reamer is a one piece tubular.

3. The downhole dual cutting reamer of claim 1, wherein the end segments engage the middle segment with welds or a threaded connection.

4. The downhole dual cutting reamer of claim 1, wherein at least one of: the plurality of polydiamond cutting nodes, the plurality of thermally stable tungsten carbide facings, and the plurality of high strength carbide cutting nodes have at least one shape selected from the group: rectangular, square, elliptical, another polygonal shape, and round.

5. The downhole dual cutting reamer of claim 1, wherein each flute has a tapered end between the helical blades.

6. The downhole dual cutting reamer of claim 1, wherein the spiral angled sections extend away from the first and second end sections at an angle from 10 degrees to 30 degrees from the longitudinal axis.

7. The downhole dual cutting reamer of claim 1, further comprising a first connector for engaging between the first end and a first bottom hole assembly, and a second connector for engaging between the second end and at a second bottom hole assembly.

8. The downhole dual cutting reamer of claim 1, further comprising a second downhole dual cutting reamer connected to a first dual cutting reamer using a third connector.

9. The downhole dual cutting reamer of claim 1, wherein each cutting section comprises from 2 helical blades to 16 helical blades.

10. The downhole dual cutting reamer of claim 1, wherein each cutting section outer diameter ranges from 3 inches to 36 inches.

11. The downhole dual cutting reamer of claim 1, wherein the downhole dual cutting reamer has an overall length from 3 inches to 16 inches.

12. The downhole dual cutting reamer of claim 1, wherein the downhole dual cutting reamer is made from a non-magnetic material.

13. The downhole dual cutting reamer of claim 1, further comprising teeth disposed on an edge of at least one helical blade.

14. The downhole dual cutting reamer of claim 1, wherein the plurality of nodes comprise at least two rows of polydiamond cutting nodes on each spiral angled section.

15. The downhole dual cutting reamer of claim 1, wherein each helical blade is tempered prior to installing the polydiamond cutting nodes, high strength carbide cutting nodes, a plurality of thermally stable tungsten carbide cutting component with at least one flush mounted rectangular brick; or combinations thereof.

* * * * *